United States Patent [19]

Mize et al.

[11] 3,982,154

[45] Sept. 21, 1976

[54] ARC DISCHARGE LAMP CONSTRUCTION FOR STARTER ELECTRODE VOLTAGE DOUBLING

[75] Inventors: Dale K. Mize, Mentor; William H. Lake, Novelty, both of Ohio

[73] Assignee: General Electric Company, Schenectady, N.Y.

[22] Filed: Sept. 2, 1975

[21] Appl. No.: 609,506

[52] U.S. Cl. ..... 315/51; 313/198; 315/60; 315/71; 315/200 R; 315/203; 315/234

[51] Int. Cl.[2] ..... H01J 17/34

[58] Field of Search ..... 315/51, 60, 71, 200 R, 315/203, 205, 234, 264, 335; 313/25, 198, 229

[56] References Cited

UNITED STATES PATENTS

| | | | |
|---|---|---|---|
| 3,527,982 | 9/1970 | Lake | 315/200 R |
| 3,619,711 | 11/1971 | Freese, Jr. | 315/60 |
| 3,666,986 | 5/1972 | Lake et al. | 313/198 X |
| 3,706,898 | 12/1972 | Peterson | 315/60 X |
| 3,771,018 | 11/1973 | Mendendorp et al. | 315/200 R |

FOREIGN PATENTS OR APPLICATIONS

| | | |
|---|---|---|
| 1,223,955 | 3/1971 | United Kingdom |

*Primary Examiner*—Eugene La Roche
*Attorney, Agent, or Firm*—Ernest W. Legree; Lawrence R. Kempton; Frank L. Neuhauser

[57] ABSTRACT

A jacketed high intensity discharge lamp utilizes a starter electrode voltage doubling circuit comprising a diode and a mica-dielectric capacitor which is electrically interposed between an inlead into the jacket and the frame side rod and forms an integral structural part of the frame which supports the arc tube. The starter electrode is resistively connected to the side rod to facilitate starting and the arrangement maintains a positive D.C. bias on the frame which reduces electrolysis of sodium through the arc tube walls.

10 Claims, 5 Drawing Figures

ARC DISCHARGE LAMP CONSTRUCTION FOR STARTER ELECTRODE VOLTAGE DOUBLING

The invention relates to high intensity discharge lamps which utilize a voltage doubling circuit coupled to a starting electrode to facilitate starting.

BACKGROUND OF THE INVENTION

In copending application of William H. Lake, Ser. No. 609,505, filed of even date, entitled "Arc Discharge Lamp With Starter Electrode Voltage Doubling" and which is assigned like this application, a lamp is disclosed having improved voltage doubling starting means which reduces the burden on the ballast and substantially eliminates electrolysis during operation. The lamp comprises a vitreous arc tube having main electrodes at opposite ends and a starter electrode adjacent one of them, an ionizable fill in the arc tube, and a voltage doubling circuit comprising a diode and a capacitor connected in series across input terminals. The circuit is poled to generate a positive potential at the junction of diode and capacitor which is coupled through a resistor to the starter electrode. The diode builds up a charge across the capacitor on one half-cycle which is added to the line voltage on the opposite half-cycle and approximately doubles the voltage provided between the starter and the selected main electrode. Voltage doubling may be provided across the gap from starter to remote main electrode, or across the gap from starter to adjacent main electrode to improve starting in different types of lamps.

The mount frame which supports the arc tube within the outer envelope is connected to the junction of the diode and capacitor in the voltage doubling circuit in order to receive a positive potential which reduces sodium loss by electrolysis through the arc tube walls. Such construction requires that at least the major portion of the mount frame be isolated from the main current inleads into the outer envelope or jacket of the lamp. If the diode and capacitor are mounted in the base of the lamp, a three-lead stem for the jacket is mandatory. This type of stem increases manufacturing costs in terms of materials, labor and tooling. It may also reduce reliability by increasing the likelihood of arc over at the stem leads during hot restart or upon arc tube failure.

By installing the diode and capacitor inside the jacket, a two-lead stem can suffice if an independent support wire for the frame is provided. Alternatively a glass bead insulator can be used to support the frame from one of the inleads while simultaneously insulating it. However these arrangements are also relatively costly and in the case of a glass bead insulator the mechanical strength may be insufficient.

SUMMARY OF THE INVENTION

The object of the invention is to provide an arc discharge lamp construction particularly suitable for use with starter electrode voltage doubling wherein the mount frame requires to be insulated from the jacket inleads and which utilizes an ordinary two-lead stem for the outer envelope.

In a jacketed high intensity discharge lamp embodying the invention, a capacitor of rigid construction such as a flat mica capacitor having stiff leads is used along with the diode for the voltage doubling circuit. The capacitor is electrically interposed between one of the inleads into the outer envelope and the frame side rod and forms an integral structural part of the frame which supports the arc tube. The starter electrode of the arc tube is connected by a resistance to the side rod to facilitate starting. The inleads into the outer envelope are connected to the main electrodes of the arc tube so that a two-lead stem suffices. The arrangement thus provides an economical way to achieve starter electrode voltage doubling and at the same time maintain a positive D.C. bias on the frame which reduces electrolysis of sodium through the arc tube walls.

DESCRIPTION OF DRAWING

In the drawings wherein like symbols denote corresponding parts in the several figures.

DESCRIPTION OF THE PREFERRED EMBODIMENT

Figure 3:
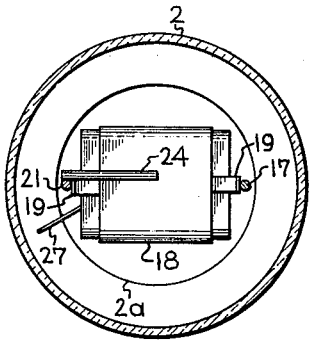
FIG. 3 is a section through the lamp along line 3—3 in FIG. 1 looking in the direction of the arrows and giving a plan view of the capacitor.
Figure 1:
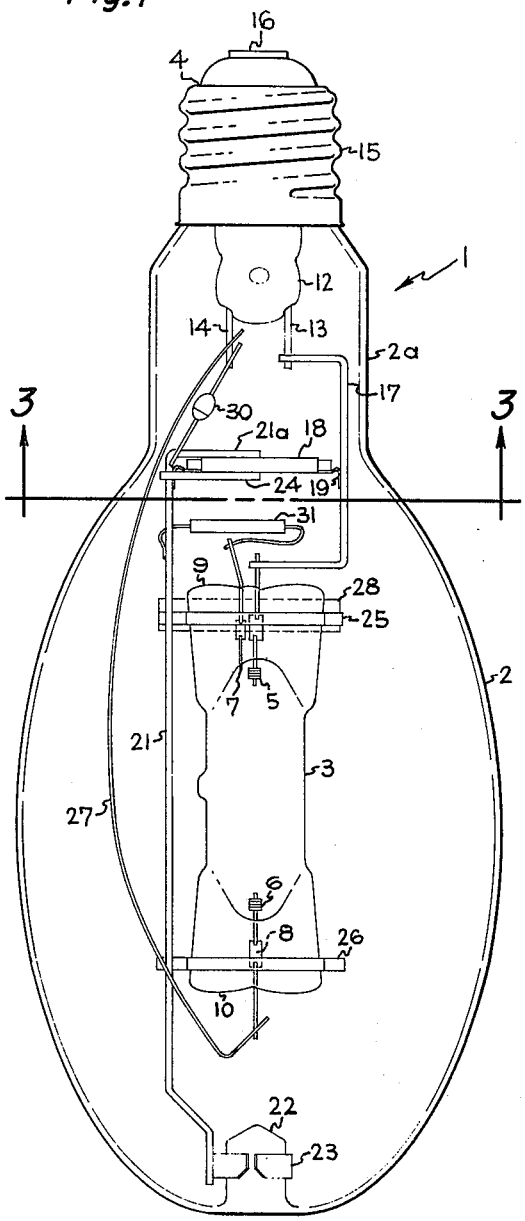
FIG. 1 is a front view of a metal halide lamp embodying the invention.
Figure 2:
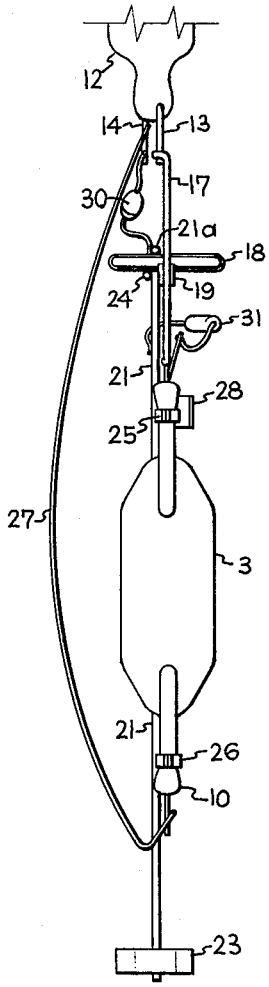
FIG. 2 is a side view of the mount of the same lamp.

FIG. 1 illustrates a metal halide lamp embodying the invention in preferred form and intended for universal operation, that is for either base-up or base-down operation. The lamp 1 comprises a vitreous outer envelope or bulb 2 and a fused silica inner arc tube 3, the outer envelope having a screw base 4 at its upper end. The arc tube contains a quantity of mercury which is substantially completely vaporized and exerts a pressure from 1 to 10 atmospheres in operation, sodium iodide in excess of the quantity vaporized, and other suitable metal halides, for instance smaller amounts of sodium iodide and thorium iodide. An inert rare gas at a low pressure, for instance argon at 25 torr, is included in the arc tube to facilitate starting and warm-up. A pair of main arcing electrodes, 5 at the upper end and 6 at the lower end plus an auxiliary starting electrode 7 at the upper end are sealed into the arc tube. The electrodes are supported on inleads which include thin molybdenum foil sections 8 extending through the pinch sealed ends 9,10 of the tube. Main electrodes 5,6 each comprise a tungsten wire around which a helix may be wrapped. Activation may be produced by a layer of thorium metal on the electrode tip which results from the decomposition of thorium iodide by the discharge. The starter electrode 7 may be a fine tungsten wire whose tip only projects into the arc tube, for instance about 1 millimeter.

The neck 2*a* of the outer envelope or jacket 2 is closed by a re-entrant stem 12 through which extend stiff inlead wires 13,14 which are connected at their outer ends one to the screw shell 15 and the other to the center contact 16 of base 4. A stiff wire 17 having its ends bent over at right angles is welded to inlead 13 at one end and to the lead wire of main electrode 5 at the other end. A mica dielectric capacitor 18 of rigid construction and generally flat rectangular shape with heavy nickel plated iron leads 19 extending from opposite ends serves as the capacitance of the voltage doubling circuit. Either the mica sheet or mica paper type may be used. In accordance with our invention the capacitor also forms an integral structural part of the frame which supports the arc tube. It is located in a plane transverse to the envelope axis about at the widening of the throat of outer envelope 2 and has one heavy lead welded to wire 17 and the other to a stiff wire or rod 21 which extends to an anchoring dimple 22 in the dome end of the jacket which it engages by a clip 23. The bent end 21*a* of rod 21 and a welded brace wire 24 engage opposite sides of capacitor 18 for added support. Wire 17 serves as a connector for main electrode 5 and thereby provides some support to the arc tube. At the same time together with capacitor 18 and rod 21 it forms a single side rod mount by which the arc tube is supported within the outer envelope. The arc tube is attached to the mount frame by clamping pinches 9,10 between straps 25,26 which are welded to rod 21. Lower main electrode 6 is connected to inlead 14 by a fine resilient curving wire 27 which extends along the jacket wall at a distance from the arc tube. Curving wire 27, sometimes known as the flying lead, serves as an electrical conductor only and provides substantially no physical support to the arc tube. The interenvelope space is evacuated and a piece 28 of getter metal is attached to rod 21 behind strap 25 as an aid to exhaust.

The voltage doubling circuit comprises capacitor 18 and a diode 30 which extends from inlead 14 to the junction of the capacitor with rod 21. Diode 30 is poled to provide a positive potential at the junction, that is at rod 21. In the illustrated arrangement the diode is shielded from the heat of the arc tube by its location behind capacitor 18. Capacitor 18 which typically may have a value of 0.1 microfarad is a high temperature mica insulated capacitor capable of withstanding the heat. A current limiting resistor 31, ranging in value from 40,000 ohms to 1 meg ohm, typically 160,000 ohms, is connected between starter electrode 7 and rod 21 and thus effectively to the junction point between diode and capacitor.

Figure 4:
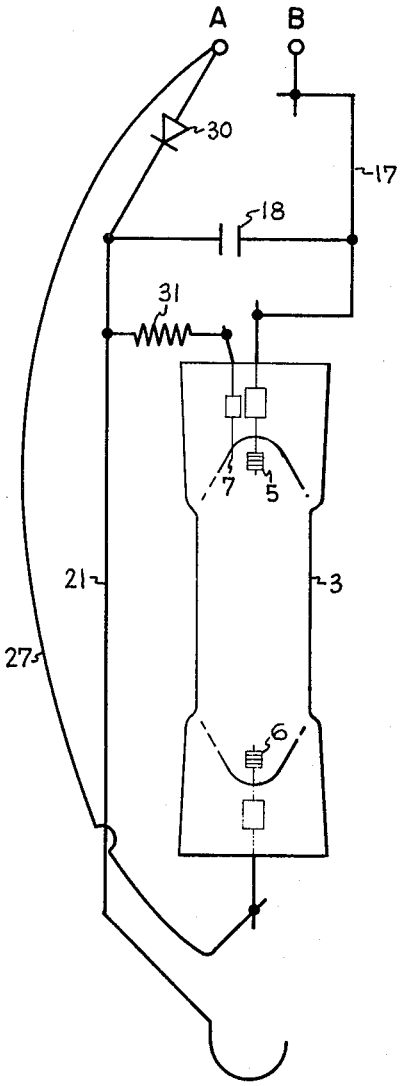
FIG. 4 is a diagram of the circuit connections in the lamp of FIG. 1.

The circuit connections of the lamp of FIG. 1 are shown diagrammatically in FIG. 4 wherein terminals A and B represent the base contact surfaces, that is end contact 16 to which the lying lead is connected, and base shell 15 respectively. Capacitor 18 charges over the positive half cycles to the peak of the terminal voltage, that is to the value +1.4E which is applied through resistance 31 to starting electrode 7 relative to main electrode 5. During the negative half cycle, a potential of −1.4 E is applied to electrode 6 relative to electrode 5 so that the potential difference between starting electrode 7 and remote main electrode 6 is approximately 2.8 E. At the same time the mount frame comprising rod 21 and straps 25,26 is maintained at a positive potential of +1.4E relative to main electrode 5 and at a potential varying from 0 to +2.8 E relative to main electrode 6.

The lamp starting circuit of FIG. 1 which is schematically represented in FIG. 4 provides voltage doubling across the long gap between the starter electrode and the remote main electrode. This is particularly effective in reducing the starting requirements, that is in lowering the open circuit voltage required to be provided by the ballast, in lamps where the glow-to-arc transition voltage or second breakdown dominates the starting characteristic. This is the case in the present lamp utilizing thorium metal activation of the electrodes which is generally less effective than metal oxide activation.

Figure 5:
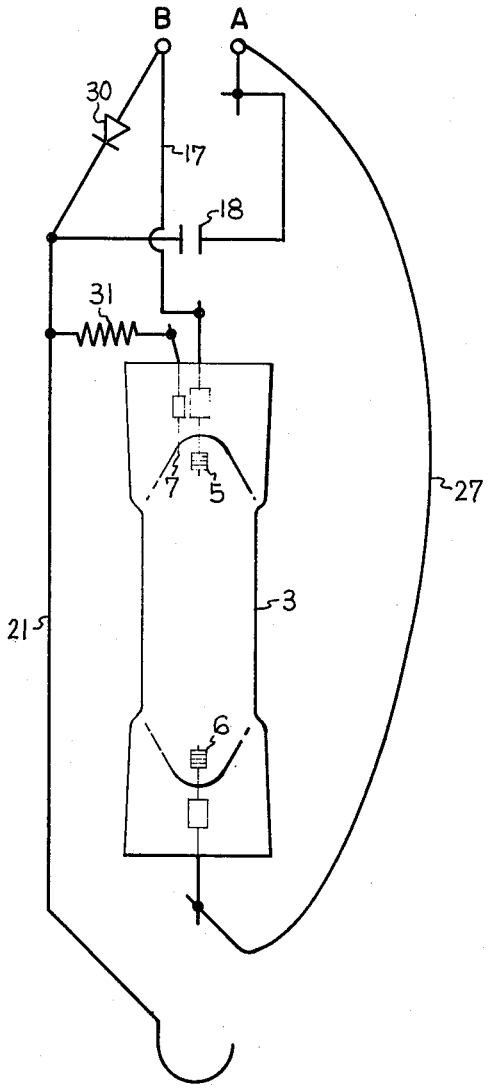
FIG. 5 is a diagram of the circuit connections in a variant.

In lamps utilizing electrodes activated in such a way as to be excellent electron emitters, as in mercury vapor lamps utilizing alkaline earth oxides and metal halide lamps using thorium oxide activation of the electrodes, the Townsend or first breakdown voltage dominates the starting characteristic. A well known example of such a metal halide lamp is one having a fill comprising mercury and sodium, thallium and indium iodides. For such lamps the voltage doubling circuit is most effective when connected to double the voltage across the short gap from starter to adjacent main electrode. A modified lamp construction suitable for this condition is illustrated diagrammatically in FIG. 5. Capacitor 18 and diode 30 are interposed in their connections to terminals A and B, respectively. The polarity of the diode is chosen to maintain a positive potential at the junction that is at frame member 21, and voltage doubling now occurs between the starter electrode and the adjacent main electrode. The physical lamp structure may remain substantially as illustrated in FIG. 1, and capacitor 18 is used as a structural part of the mount frame in the same way.

What we claim as new and desire to secure by Letters Patent of the U.S. is:

1. An arc discharge lamp comprising:

a vitreous arc tube containing an ionizable medium and having two main electrodes plus a starter electrode sealed therein;

an outer envelope enclosing said arc tube and having a pair of inleads sealed thereinto;

a voltage doubling circuit comprising a diode and a capacitor within said outer envelope connected in series across said inleads, said capacitor being of rigid construction with two stiff leads, one of said stiff leads being fastened to one of said inleads;

a mount frame including said capacitor as a structural component, said mount frame having a portion fastened to the other stiff lead and supporting said arc tube;

said diode being poled to develop a positive potential on said frame portion whereby to oppose positive ion electrolysis through the walls of said arc tube;

connections from said inleads to the main electrodes in the arc tube;

and means connecting said mount frame portion to said starter electrode in order to apply a positive voltage thereto to facilitate starting.

2. A lamp as in claim 1 wherein the means connecting said mount frame position to said starter electrode is a resistor.

3. A lamp as in claim 1 wherein the ionizable medium within said arc tube includes a sodium halide.

4. A high intensity arc discharge lamp comprising:

a vitreous arc tube containing an ionizable medium and having main electrodes sealed into opposite ends plus a starter electrode adjacent to the main electrode at one end;

an outer envelope enclosing said arc tube and having a stem at one end with a pair of inleads sealed therethrough;

a base attached to said outer envelope and having input terminals, said inleads being connected exteriorly to said input terminals;

a voltage doubling circuit comprising a diode and a capacitor within said outer envelope forming a series circuit across said input terminals, said capacitor being of rigid construction with heavy leads, one of said heavy leads being connected to one of said inleads;

a mount rod fastened to the other of said heavy leads and extending through said envelope towards the dome end;

attachments from said mount rod to said arc tube for supporting it;

said diode being connected between said other inlead and said mount rod and poled to develop a positive potential on the mount rod whereby to oppose positive ion electrolysis through the walls of said arc tube;

a rigid connector extending from one inlead to the lead wire of the main electrode at the near end of the arc tube and a flexible flying lead extending from the other inlead to the lead wire of the main electrode at the far end of the arc tube;

and a resistor connecting said mount rod to said starter electrode in order to apply a positive voltage thereto to facilitate starting.

5. A lamp as in claim 4 wherein the capacitor is of rigid mica-dielectric construction.

6. A lamp as in claim 4 wherein the ionizable medium within said arc tube includes a sodium halide.

7. A lamp as in claim 4 wherein the rigid connector to the main electrode at the near end of the arc tube and the capacitor are connected to the same inlead whereby voltage doubling occurs across the gap between the main electrode at the remote end of the arc tube and the starter electrode.

8. A lamp as in claim 7 wherein the ionizable filling comprises mercury, sodium iodide, scandium iodide and thorium iodide.

9. A lamp as in claim 4 wherein the flexible flying lead to the main electrode at the remote end of the arc tube and the capacitor are connected to the same inlead whereby voltage doubling occurs across the gap between the main electrode at the near end of the arc tube and the starter electrode.

10. A lamp as in claim 9 wherein the ionizable medium includes mercury, sodium iodide, thallium iodide and indium iodide.

* * * * *